US011771136B2

(12) United States Patent
Hejazi et al.

(10) Patent No.: US 11,771,136 B2
(45) Date of Patent: Oct. 3, 2023

(54) AEROSOL DELIVERY DEVICE

(71) Applicant: RAI Strategic Holdings, Inc., Winston-Salem, NC (US)

(72) Inventors: Vahid Hejazi, Concord, NC (US); Cassidy S. McMahan, Pfafftown, NC (US)

(73) Assignee: RAI Strategic Holdings, Inc., Winston-Salem, NC (US)

( * ) Notice: Subject to any disclaimer, the term of this patent is extended or adjusted under 35 U.S.C. 154(b) by 307 days.

(21) Appl. No.: 17/034,225

(22) Filed: Sep. 28, 2020

(65) Prior Publication Data

US 2022/0095686 A1 Mar. 31, 2022

(51) Int. Cl.

| | |
|---|---|
| ***A24F 40/50*** | (2020.01) |
| ***A24F 40/10*** | (2020.01) |
| ***A24F 40/48*** | (2020.01) |
| ***A24F 40/46*** | (2020.01) |
| ***A24F 40/42*** | (2020.01) |

(52) U.S. Cl.

CPC ..... *A24F 40/50* (2020.01); *A24F 40/10* (2020.01); *A24F 40/42* (2020.01); *A24F 40/46* (2020.01); *A24F 40/48* (2020.01)

(58) Field of Classification Search

CPC ..... A24F 40/42; A24F 40/10; A24F 40/50; A24F 40/05; A24F 40/48; A24F 40/46

See application file for complete search history.

(56) References Cited

U.S. PATENT DOCUMENTS 4,639,368 A 1/1987 Niazi et al.
4,674,519 A 6/1987 Kertitsis et al.

(Continued)

FOREIGN PATENT DOCUMENTS

EP 3393567 10/2018
WO WO 1997/06786 2/1997

(Continued)

OTHER PUBLICATIONS

*Chemical and Biological Studies on New Cigarette Prototypes that Heat Instead of Burn Tobacco*, R. J. Reynolds Tobacco Company Monograph (1988).

(Continued)

*Primary Examiner* — Jean F Duverne

(74) *Attorney, Agent, or Firm* — Womble Bond Dickinson (US) LLP

(57) ABSTRACT

The present disclosure provides aerosol delivery devices having a variety of configurations and arrangements. Some aspects of the disclosure provide aerosol delivery devices having a housing with an air pathway extending at least partially therethrough, a reservoir configured to contain a content of a liquid composition, an intermediate chamber configured to temporarily store a fractional content of the liquid composition, a micropump interconnecting the reservoir and the intermediate chamber and configured to deliver the fractional content of the liquid composition from the reservoir to the intermediate chamber under pressure, and a mesh layer positioned at least partially between the intermediate chamber and the air pathway, the mesh layer being adapted to transfer the liquid composition received from the immediate chamber into the air pathway forming an aerosol.

27 Claims, 5 Drawing Sheets

(56) References Cited

U.S. PATENT DOCUMENTS 4,735,217 A 4/1988 Gerth et al.
4,793,365 A 12/1988 Sensabaugh et al.
4,807,809 A 2/1989 Pryor et al.
4,836,224 A 6/1989 Lawson et al.
4,889,143 A 12/1989 Pryir et al.
4,922,901 A 5/1990 Brooks et al.
4,924,887 A 5/1990 Raker et al.
4,924,888 A 5/1990 Perfetti et al.
4,941,484 A 7/1990 Clapp et al.
4,947,874 A 8/1990 Brooks et al.
4,972,854 A 11/1990 Kiernan et al.
4,987,906 A 1/1991 Young et al.
5,025,814 A 6/1991 Raker et al.
5,056,537 A 10/1991 Brown et al.
5,060,671 A 10/1991 Counts et al.
5,093,894 A 3/1992 Deevi et al.
5,099,864 A 3/1992 Young et al.
5,101,839 A 4/1992 Jakob et al.
5,143,097 A 9/1992 Sohn et al.
5,154,192 A 10/1992 Sprinkel et al.
5,159,942 A 11/1992 Brinkley et al.
5,178,878 A 1/1993 Wehling et al.
5,220,930 A 6/1993 Gentry
5,223,264 A 6/1993 Wehling et al.
5,228,460 A 7/1993 Sprinkel, Jr. et al.
5,249,586 A 10/1993 Morgan et al.
5,261,424 A 11/1993 Sprinkel, Jr. et al.
5,322,075 A 6/1994 Deevi et al.
5,322,076 A 6/1994 Brinkley et al.
5,339,838 A 8/1994 Young et al.
5,353,813 A 10/1994 Deevi et al.
5,360,023 A 11/1994 Blakley et al.
5,372,148 A 12/1994 McCafferty et al.
5,377,698 A 1/1995 Litzinger et al.
5,468,936 A 11/1995 Deevi et al.
5,498,850 A 3/1996 Das
5,498,855 A 3/1996 Deevi et al.
5,501,237 A 3/1996 Young et al.
5,530,225 A 6/1996 Hajaligol
5,551,451 A 9/1996 Riggs et al.
5,573,692 A 11/1996 Das et al.
5,591,368 A 1/1997 Fleischhauer et al.
5,665,262 A 9/1997 Hajaligol
5,666,977 A 9/1997 Higgins et al.
5,697,385 A 12/1997 Seymour et al.
5,934,289 A 8/1999 Watkins et al.
5,954,979 A 9/1999 Counts et al.
5,967,148 A 10/1999 Harris et al.
6,040,560 A 3/2000 Fleischhauer et al.
6,053,176 A 4/2000 Adams et al.
6,164,287 A 12/2000 White
6,196,218 B1 3/2001 Voges
6,216,707 B1 4/2001 Kumar et al.
6,701,936 B2 3/2004 Shafer et al.
6,772,756 B2 8/2004 Shayan
6,803,545 B2 10/2004 Blake et al.
6,810,883 B2 11/2004 Felter et al.
6,854,461 B2 2/2005 Nichols
6,974,590 B2 12/2005 Pather et al.
7,011,096 B2 3/2006 Li et al.
7,017,585 B2 3/2006 Li et al.
7,025,066 B2 4/2006 Lawson et al.
7,040,314 B2 5/2006 Nguyen et al.
7,290,549 B2 11/2007 Banerjee et al.
7,293,565 B2 11/2007 Griffen et al.
7,381,667 B2 6/2008 Bergquist et al.
7,398,783 B2 7/2008 Biggs et al.
7,513,253 B2 4/2009 Kobayashi
7,615,184 B2 11/2009 Lobovsky
7,647,932 B2 1/2010 Cantrell et al.
7,726,320 B2 6/2010 Robinson et al.
7,832,410 B2 11/2010 Hon
7,836,897 B2 11/2010 Borschke et al.
7,896,006 B2 3/2011 Hamano
8,205,622 B2 6/2012 Pan
8,402,976 B2 3/2013 Fernando et al.
8,424,541 B2 4/2013 Crawford et al.
8,430,106 B2 4/2013 Potter et al.
8,627,828 B2 1/2014 Strickland et al.
8,794,231 B2 8/2014 Thorens et al.
8,839,799 B2 9/2014 Conner et al.
8,851,083 B2 10/2014 Oglesby et al.
8,881,737 B2 11/2014 Collett et al.
8,910,639 B2 12/2014 Chang et al.
8,915,254 B2 12/2014 Monsees et al.
9,078,473 B2 7/2015 Worm et al.
9,107,453 B2 8/2015 Dube et al.
9,149,072 B2 10/2015 Conner et al.
9,215,895 B2 12/2015 Bowen et al.
9,220,302 B2 12/2015 DePiano et al.
9,254,002 B2 2/2016 Chong et al.
9,307,787 B2 4/2016 Sun et al.
9,423,152 B2 8/2016 Ampolini et al.
9,484,155 B2 11/2016 Peckerar et al.
9,609,893 B2 4/2017 Novak et al.
9,675,102 B2 6/2017 Hunt et al.
9,839,237 B2 12/2017 Chang et al.
9,839,238 B2 12/2017 Worm et al.
9,861,773 B2 1/2018 Terry et al.
9,974,334 B2 5/2018 Dooley et al.
10,015,989 B2 7/2018 Davis et al.
10,034,494 B2 7/2018 Ampolini et al.
10,058,123 B2 8/2018 Taluskie et al.
10,058,125 B2 8/2018 Worm et al.
10,172,388 B2 1/2019 Sears et al.
10,196,778 B2 2/2019 Sebastian et al.
10,285,451 B2 5/2019 Bless et al.
10,500,600 B2 12/2019 Henry, Jr. et al.
10,506,833 B2 12/2019 Manca et al.
10,813,385 B2 10/2020 Sur
10,834,971 B2 11/2020 Manca et al.
2004/0255968 A1 12/2004 Perfetti et al.
2005/0066986 A1 3/2005 Nestor et al.
2006/0196518 A1 9/2006 Hon
2007/0215167 A1 9/2007 Crooks et al.
2008/0236602 A1 10/2008 Bereman
2009/0044818 A1 2/2009 Takeuchi et al.
2010/0018539 A1 1/2010 Brinkley et al.
2010/0024834 A1 2/2010 Ogelsby et al.
2010/0307518 A1 12/2010 Wang
2013/0008457 A1 1/2013 Zheng et al.
2013/0255702 A1 10/2013 Griffith et al.
2014/0096781 A1 4/2014 Sears et al.
2015/0020823 A1 1/2015 Lipowicz et al.
2015/0020830 A1 1/2015 Koller et al.
2015/0216232 A1 8/2015 Bless et al.
2015/0313283 A1 11/2015 Collett et al.
2015/0335070 A1 11/2015 Sears et al.
2016/0007651 A1 1/2016 Ampolini et al.
2016/0219933 A1 8/2016 Henry, Jr. et al.
2016/0261020 A1 9/2016 Marion et al.
2016/0262454 A1* 9/2016 Sears ..... A24F 40/485
2017/0027220 A1 2/2017 Sebastian et al.
2017/0112196 A1 4/2017 Sur et al.
2017/0291757 A1 10/2017 Sebastian et al.
2018/0020722 A1 1/2018 Davis et al.
2018/0020723 A1 1/2018 Davis et al.
2018/0146710 A1* 5/2018 Bessant ..... A61M 11/042
2018/0146711 A1 5/2018 Mazur et al.
2018/0274354 A1 9/2018 Nesgaard
2018/0279673 A1 10/2018 Sebastian et al.
2019/0082735 A1 3/2019 Phillips et al.
2019/0124979 A1 5/2019 Sebastian et al.
2019/0281890 A1 9/2019 Sur
2020/0163389 A1 5/2020 Sur
2020/0230329 A1 7/2020 Danek
2021/0177040 A1 6/2021 Dickens et al.
2021/0267262 A1 9/2021 Mathie et al.
2021/0368850 A1 12/2021 Mathie et al.
2021/0368852 A1 12/2021 Cabot
2021/0378282 A1 12/2021 Cabot
2021/0386110 A1 12/2021 Cabot

(56) References Cited

U.S. PATENT DOCUMENTS

| | | | |
|---|---|---|---|
| 2021/0386111 | A1 | 12/2021 | Cabot |
| 2022/0000167 | A1 | 1/2022 | Cabot |
| 2022/0071267 | A1 | 3/2022 | Cabot |

FOREIGN PATENT DOCUMENTS

| | | |
|---|---|---|
| WO | WO 1998/57556 | 12/1998 |
| WO | WO 2010/003480 | 1/2010 |
| WO | WO 2013/089551 | 6/2013 |
| WO | WO 2014/182736 | 11/2014 |
| WO | WO 2017/108268 | 6/2017 |
| WO | WO 2020/089631 | 5/2020 |
| WO | WO 2020/089633 | 5/2020 |
| WO | WO 2020/089634 | 5/2020 |
| WO | WO 2020/089635 | 5/2020 |
| WO | WO 2020/089636 | 5/2020 |
| WO | WO 2020/089637 | 5/2020 |
| WO | WO 2020/089638 | 5/2020 |
| WO | WO 2020/089639 | 5/2020 |
| WO | WO 2020/089640 | 5/2020 |
| WO | WO 2020/089641 | 5/2020 |

OTHER PUBLICATIONS

Leffingwell et al., "Tobacco Flavoring for Smoking Products", *R. J. Reynolds Tobacco Company*, 1972, pp. 1-72.

* cited by examiner

AEROSOL DELIVERY DEVICE

BACKGROUND

Field of the Disclosure

The present disclosure relates to aerosol delivery devices and uses thereof for yielding aerosol precursor compositions in inhalable form. In various implementations, the aerosol precursor composition, which may incorporate materials and/or components that may be made or derived from tobacco or otherwise incorporate tobacco or other plants, may include natural or synthetic components including flavorants, and/or may include one or more medicinal components, is vaporized by the atomization assembly to produce an inhalable substance for human consumption.

Description of Related Art

Many smoking devices have been proposed through the years as improvements upon, or alternatives to, smoking products that require combusting tobacco for use. Many of those devices purportedly have been designed to provide the sensations associated with cigarette, cigar, or pipe smoking, but without delivering considerable quantities of incomplete combustion and pyrolysis products that result from the burning of tobacco. To this end, there have been proposed numerous smoking products, flavor generators, and medicinal inhalers that utilize electrical energy to vaporize or heat a volatile material, or attempt to provide the sensations of cigarette, cigar, or pipe smoking without burning tobacco to a significant degree. See, for example, the various alternative smoking articles, aerosol delivery devices, and heat generating sources set forth in the background art described in U.S. Pat. No. 7,726,320 to Robinson et al., U.S. Pat. App. Pub. No. 2013/0255702 to Griffith Jr. et al., and U.S. Pat. App. Pub. No. 2014/0096781 to Sears et al., which are incorporated herein by reference in their entireties. See also, for example, the various types of smoking articles, aerosol delivery devices, and electrically powered sources referenced by brand name and commercial source in U.S. Pat. App. Pub. No. 2015/0216232 to Bless et al., which is incorporated herein by reference in its entirety.

However, it would be desirable to provide an aerosol delivery device with enhanced functionality. In this regard, it is desirable to provide an aerosol delivery with advantageous features.

BRIEF SUMMARY

Some embodiments of the present disclosure provide an aerosol delivery device including a housing with an air pathway extending at least partially therethrough, a reservoir configured to contain a content of a liquid composition, an intermediate chamber configured to temporarily store a fractional content of the liquid composition, a micropump interconnecting the reservoir and the intermediate chamber and configured to deliver the fractional content of the liquid composition from the reservoir to the intermediate chamber under pressure, and a mesh layer positioned at least partially between the intermediate chamber and the air pathway, the mesh layer being adapted to transfer the liquid composition received from the intermediate chamber into the air pathway forming an aerosol.

In some embodiments, the micropump may be selected from the group consisting of a centrifugal micropump, a ring micropump, a rotary micropump, a diaphragm micropump, a peristaltic micropump, a step micropump, and combinations thereof. In some embodiments, the housing may comprise at least one opening for receiving air, wherein the air pathway is in fluid communication with the at least one opening such that air is drawn into the air pathway from outside of the aerosol delivery device when a drawing force is applied to the aerosol delivery device by a user. In some embodiments, the aerosol delivery device may further comprise a forced air component configured to draw air from outside of the housing and through the air pathway. In various embodiments, the forced air component may be selected from the group consisting of a micro-compressor pump, a micro-blower, a rotary micropump, a diaphragm micropump, a piezoceramic micropump, and combinations thereof.

In some embodiments, the intermediate chamber may be substantially disk-shaped and in connection with the mesh layer. In some embodiments, the aerosol delivery device may further comprise a second chamber that is in connection with the intermediate chamber and fluidly connected with the reservoir. In some embodiments, the liquid composition may be a water-based aerosol precursor composition. In some embodiments, the water-based aerosol precursor composition may comprise about 60% or greater water by weight, 65% or greater water by weight, 70% or greater water by weight, 75% or greater water by weight, 80% or greater water by weight, 85% or greater water by weight, 90% or greater water by weight, or 95% or greater water by weight, based on the total weight of the water-based aerosol precursor composition. In some embodiments, the water-based aerosol precursor composition may further comprise an active ingredient, such as nicotine. In some embodiments, the water-based aerosol precursor composition may additionally or alternatively comprise one or more of an acid, a polyhydric alcohol, a flavorant, and a botanical extract, such as a tobacco extract. In some embodiments, the water-based aerosol precursor composition may additionally or alternatively include other active ingredients including, but not limited to, botanical ingredients (e.g., lavender, peppermint, chamomile, basil, rosemary, ginger, *cannabis, ginseng*, maca, hemp, *eucalyptus*, rooibos, fennel, citrus, cloves, and tisanes), stimulants (e.g., caffeine and guarana), amino acids (e.g., taurine, theanine, phenylalanine, tyrosine, and tryptophan) and/or pharmaceutical, nutraceutical, medicinal ingredients (e.g., vitamins, such as B6, B12, and C, and/or cannabinoids, such as tetrahydrocannabinol (THC) and cannabidiol (CBD)).

In some embodiments, the aerosol delivery device may further comprise an input element configured to be operated by a user of the aerosol delivery device and in communication with a control component. In some embodiments, the control component may be in communication with the micropump and may be configured to control the amount of the liquid composition transferred from the reservoir to the intermediate chamber via the micropump. In some embodiments, the input element may be configured to allow a user to adjust the amount of nicotine delivered per puff. In some embodiments, the input element may be configured to adjust the amount of total particulate matter (TPM) released per puff.

In some embodiments, the mesh layer may be a porous mesh or porous ceramic material. In some embodiments, the mesh layer may be substantially linear or substantially curved. In some embodiments, the mesh layer may include a plurality of openings extending therethrough. In some embodiments, the plurality of openings may include from about 400 openings to about 4000 openings. In some embodiments, the plurality of openings may each extend from an inner surface of the mesh layer to an outer surface of the mesh layer, and a diameter of the plurality of openings may change from the inner surface to the outer surface. In some embodiments, the diameter of the plurality of openings may be relatively smaller at the inner surface of the mesh layer and relatively larger at the outer surface of the mesh layer. In some embodiments, the smaller side may be about 0.5 microns to about 5 microns in diameter and the larger side may be about 2 microns to about 100 microns in diameter.

In some embodiments, the reservoir may be replaceable or refillable by a user of the aerosol delivery device. In some embodiments, the content of the liquid composition in the reservoir may be sufficient to equate to substantially 50 puffs to a user of the aerosol delivery device prior to depletion of the liquid composition. In some embodiments the aerosol delivery device may further comprise a power source and a second control component, wherein the second control component may be configured to control the power output from the power source. In some embodiments, the aerosol delivery device may further comprise a mouthpiece portion configured to receive the aerosol from the air pathway and having an opening for egress of the aerosol therefrom. In some embodiments, the mesh layer may be heated, for example, in some embodiments the aerosol delivery device may include a separate heater configured to heat the mesh layer and/or the control component may be configured to direct an electrical current flow from the power source to the mesh layer to heat the mesh layer. In some embodiments, the heated mesh layer may have an increased surface energy as compared to a non-heated mesh layer.

The present disclosure includes, without limitation, the following embodiments:

Embodiment 1: An aerosol delivery device comprising: a housing with an air pathway extending at least partially therethrough; a reservoir configured to contain a content of a liquid composition; an intermediate chamber configured to temporarily store a fractional content of the liquid composition; a micropump interconnecting the reservoir and the intermediate chamber and configured to deliver the fractional content of the liquid composition from the reservoir to the intermediate chamber under pressure; and a mesh layer positioned at least partially between the intermediate chamber and the air pathway, the mesh layer being adapted to transfer the liquid composition received from the intermediate chamber into the air pathway forming an aerosol.

Embodiment 2: The aerosol delivery device of embodiment 1, wherein the micropump is selected from the group consisting of a centrifugal micropump, a ring micropump, a rotary micropump, a diaphragm micropump, a peristaltic micropump, a step micropump, and combinations thereof.

Embodiment 3: The aerosol delivery device of embodiment 1 or 2, wherein the housing comprises at least one opening for receiving air, and wherein the air pathway is in fluid communication with the at least one opening such that air is drawn into the air pathway from outside of the aerosol delivery device when a drawing force is applied to the aerosol delivery device by a user.

Embodiment 4: The aerosol delivery device of any of embodiments 1-3, wherein the aerosol delivery device further comprises a forced air component configured to draw air from outside of the housing through the air pathway.

Embodiment 5: The aerosol delivery device of any of embodiments 1-4, wherein the forced air component is selected from the group consisting of a micro-compressor pump, a micro-blower, a rotary micropump, a diaphragm micropump, a piezoceramic micropump, and combinations thereof.

Embodiment 6: The aerosol delivery device of any of embodiments 1-5, wherein the intermediate chamber is substantially disk-shaped and is in connection with the mesh layer.

Embodiment 7: The aerosol delivery device of any of embodiments 1-6, wherein the aerosol delivery device further comprises a second chamber that is in connection with the intermediate chamber and this is fluidly connected with the reservoir.

Embodiment 8: The aerosol delivery device of any of embodiments 1-7, wherein the liquid composition is a water-based aerosol precursor composition.

Embodiment 9: The aerosol delivery device of any of embodiments 1-8, wherein the water-based aerosol precursor composition comprises about 60% or greater water by weight, based on the total weight of the water-based aerosol precursor composition.

Embodiment 10: The aerosol delivery device of any of embodiments 1-9, wherein the water-based aerosol precursor composition comprises one or more of a polyhydric alcohol, tobacco, a tobacco extract, a flavorant, an acid, a nicotine component, botanicals, nutraceuticals, stimulants, amino acids, vitamins, cannabinoids, and combinations thereof.

Embodiment 11: The aerosol delivery device of any of embodiments 1-10, further comprising an input element configured to be operated by a user of the aerosol delivery device and in communication with a control component.

Embodiment 12: The aerosol delivery device of any of embodiments 1-11, wherein the control component is in communication with the micropump and configured to control the amount of the liquid composition transferred from the reservoir to the intermediate chamber via the micropump.

Embodiment 13: The aerosol delivery device of any of embodiments 1-12, wherein the input element is configured to allow a user to adjust the amount of nicotine delivered per puff.

Embodiment 14: The aerosol delivery device of any of embodiments 1-13, wherein the input element is configured to adjust the amount of total particulate matter (TPM) released per puff.

Embodiment 15: The aerosol delivery device of any of embodiments 1-14, wherein the mesh layer is a porous mesh or porous ceramic material.

Embodiment 16: The aerosol delivery device of any of embodiments 1-15, wherein the mesh layer is substantially linear or substantially curved.

Embodiment 17: The aerosol delivery device of any of embodiments 1-16, wherein the mesh layer comprises a plurality of openings extending therethrough.

Embodiment 18: The aerosol delivery device of any of embodiments 1-17, wherein the plurality of openings comprises from about 400 openings to about 4000 openings.

Embodiment 19: The aerosol delivery device of any of embodiments 1-18, wherein the plurality of openings each extend from an inner surface of the mesh layer to an outer surface of the mesh layer, and wherein a diameter of the plurality of openings changes from the inner surface to the outer surface.

Embodiment 20: The aerosol delivery device of any of embodiments 1-19, wherein the diameter of the plurality of openings is relatively smaller at the inner surface of the mesh layer and is relatively larger at the outer surface of the mesh layer.

Embodiment 21: The aerosol delivery device of any of embodiments 1-20, wherein the smaller side is about 0.5 microns to about 5 microns in diameter and the larger side is about 2 microns to about 100 microns in diameter.

Embodiment 22: The aerosol delivery device of any of embodiments 1-21, wherein the reservoir is replaceable or refillable by a user of the aerosol delivery device.

Embodiment 23: The aerosol delivery device of any of embodiments 1-22, wherein the content of the liquid composition in the reservoir is sufficient to equate to substantially 50 puffs to a user of the device prior to depletion of the liquid composition.

Embodiment 24: The aerosol delivery device of any of embodiments 1-23, further comprising a power source and a second control component, wherein the second control component is configured to control the power output from the power source.

Embodiment 25: The aerosol delivery device of any of embodiments 1-24, further comprising a mouthpiece portion configured to receive the aerosol from the air pathway and having an opening for egress of the aerosol therefrom.

Embodiment 26: The aerosol delivery device of any of embodiments 1-25, wherein the mesh layer is heated.

Embodiment 27: The aerosol delivery device of any of embodiments 1-26, wherein the heated mesh layer has an increased surface energy as compared to a non-heated mesh layer.

These and other features, aspects, and advantages of the disclosure will be apparent from a reading of the following detailed description together with the accompanying drawings, which are briefly described below. The invention includes any combination of two, three, four, or more of the above-noted embodiments as well as combinations of any two, three, four, or more features or elements set forth in this disclosure, regardless of whether such features or elements are expressly combined in a particular embodiment description herein. This disclosure is intended to be read holistically such that any separable features or elements of the disclosed invention, in any of its various aspects or embodiments, should be viewed as combinable unless the context clearly dictates otherwise.

BRIEF DESCRIPTION OF THE FIGURES

Figure 1:
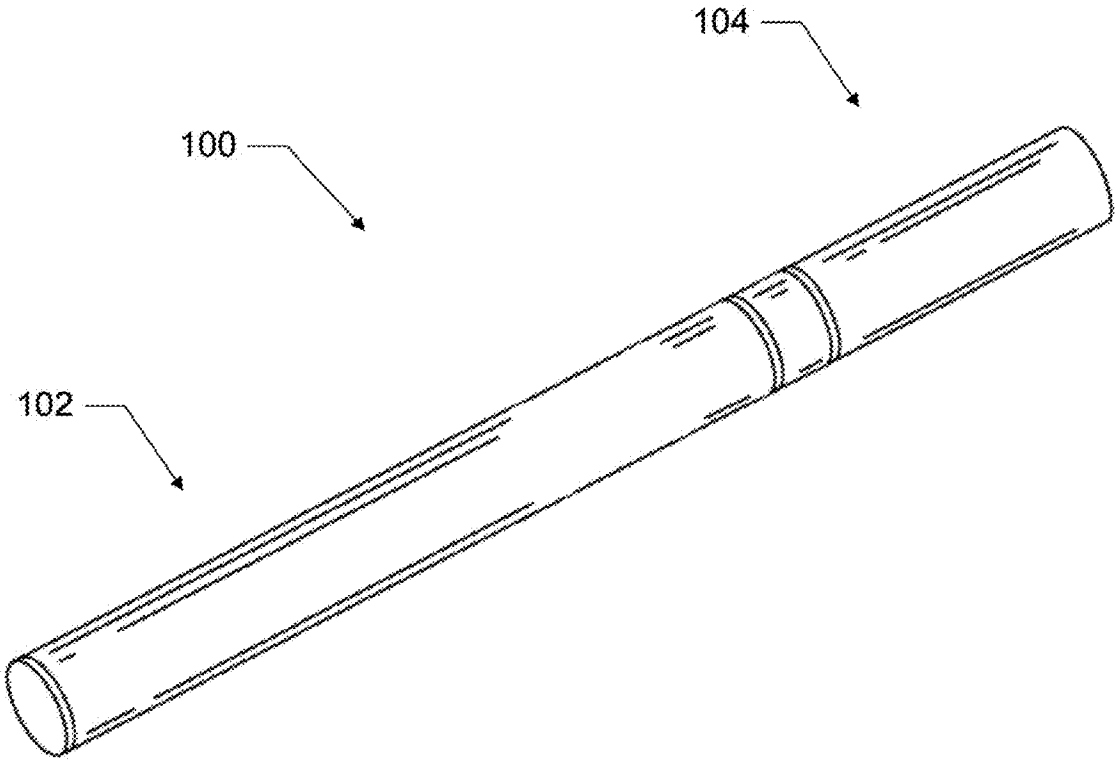
Figure 2:
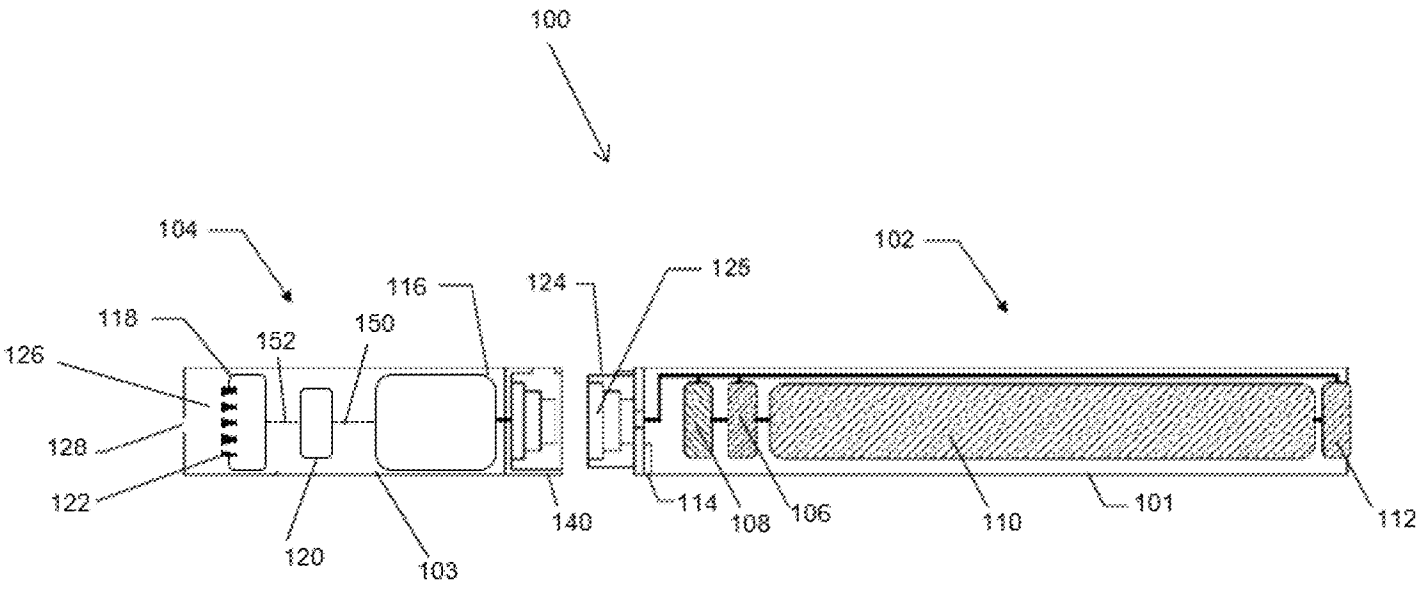
Figure 3:
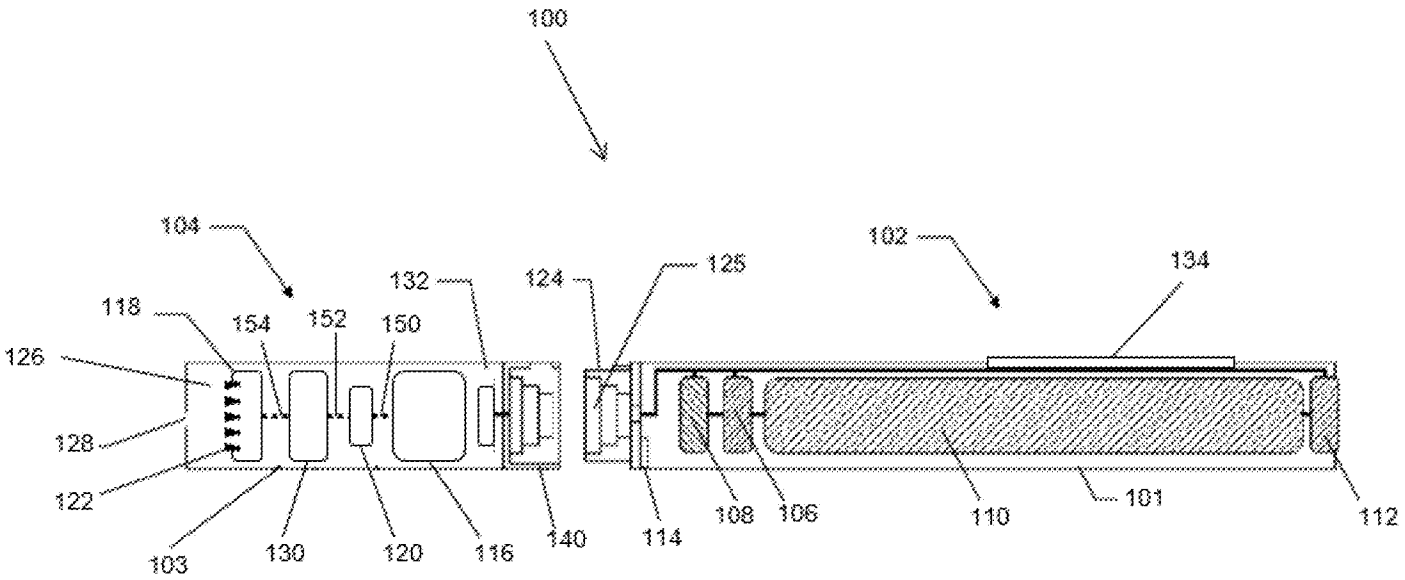
Figure 4:
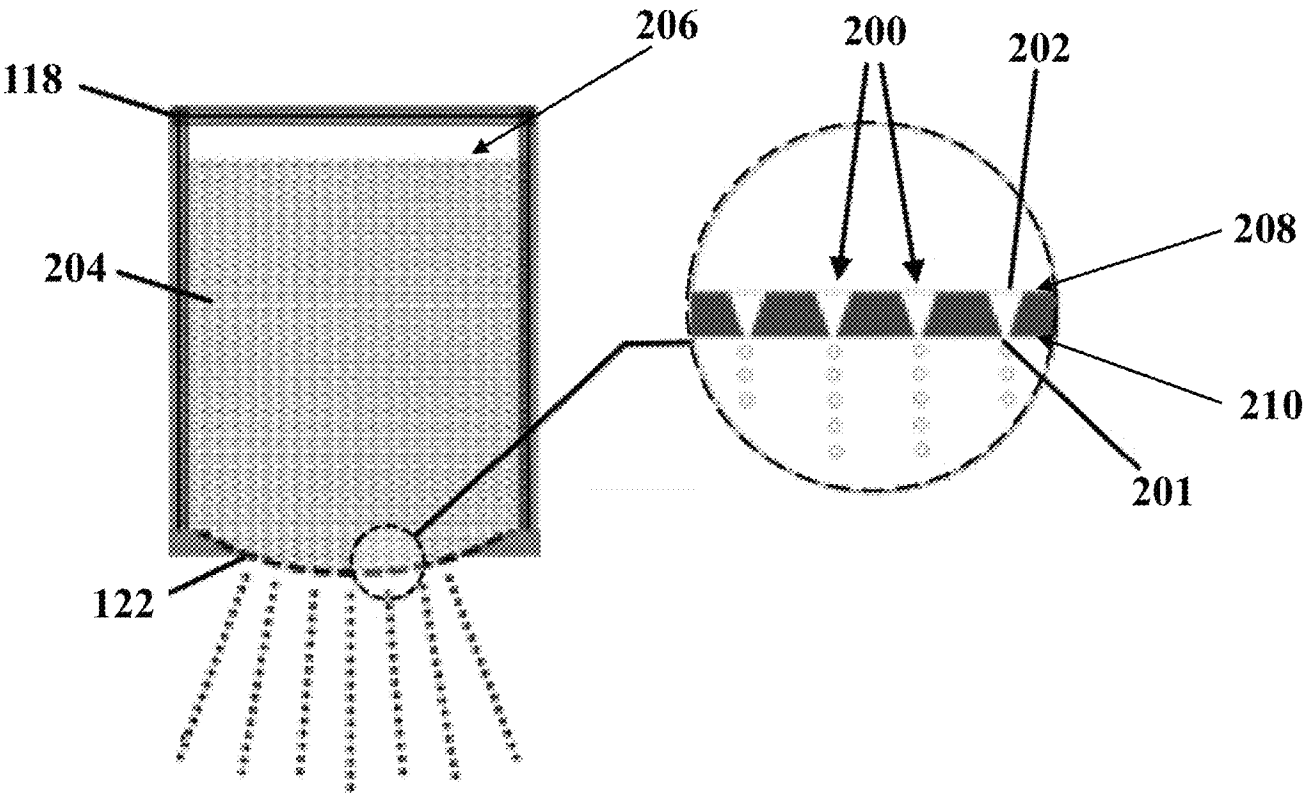
Figure 5:
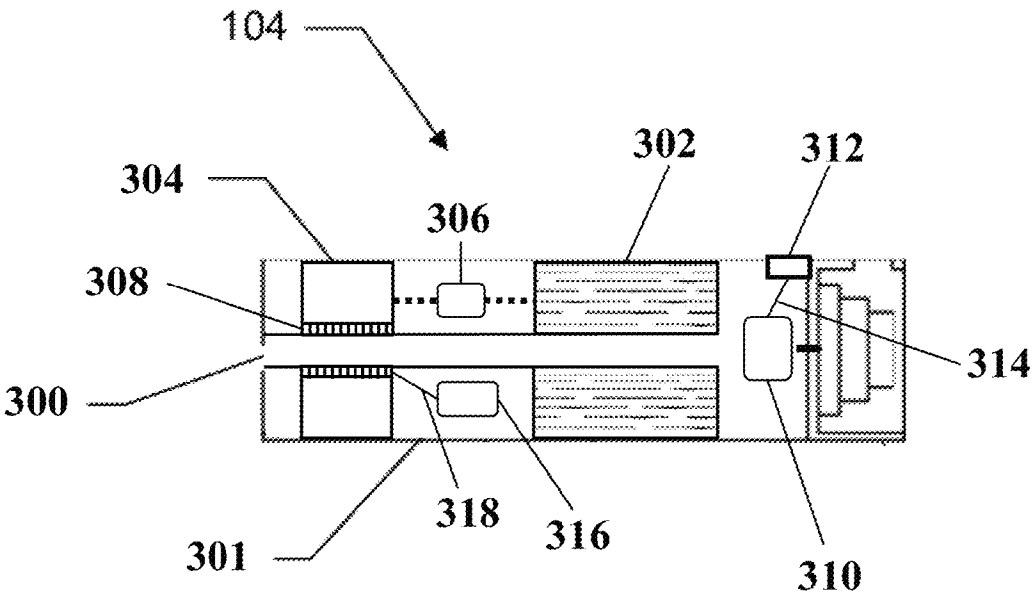

Having thus described aspects of the disclosure in the foregoing general terms, reference will now be made to the accompanying drawings, which are not necessarily drawn to scale, and wherein:

FIG. 1 illustrates a perspective view of an aerosol delivery device including a control unit and cartridge, wherein the cartridge and the control unit are coupled to one another, according to an example embodiment of the present disclosure;

FIG. 2 illustrates a side cross-section schematic view of the aerosol delivery device of FIG. 1 wherein the cartridge and the control unit are decoupled from one another, according to an example embodiment of the present disclosure;

FIG. 3 illustrates a side cross-section schematic view of the aerosol delivery device of FIG. 1 wherein the cartridge and the control unit are decoupled from one another, according to another example embodiment of the present disclosure;

FIG. 4 illustrates a partially cut-away perspective view of the interface between an intermediate chamber and a mesh layer, according to an example embodiment of the present disclosure; and FIG. 5 illustrates a partially cut-away side view of the cartridge of FIG. 1 wherein the cartridge further comprises an air pathway, an air intake, a heater, and a forced-air component, according to an example embodiment of the present disclosure.

DETAILED DESCRIPTION

The present disclosure will now be described more fully hereinafter with reference to example embodiments thereof. These example embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in the specification and the appended claims, the singular forms "a," "an," "the" and the like include plural referents unless the context clearly dictates otherwise. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As described hereinafter, embodiments of the present disclosure relate to aerosol delivery devices or vaporization devices, said terms being used herein interchangeably. Aerosol delivery devices according to the present disclosure can generate monodispersed aerosol particles to form an inhalable substance; and components of such devices have the form of articles that most preferably are sufficiently compact to be considered hand-held devices. That is, use of components of some aerosol delivery devices does not result in the production of smoke—i.e., from by-products of combustion or pyrolysis of tobacco, but rather, use of those preferred systems results in the production of vapors resulting from vaporization of a liquid composition. In some examples, components of aerosol delivery devices may be characterized as electronic cigarettes, and those electronic cigarettes most preferably incorporate tobacco and/or components derived from tobacco, and hence deliver tobacco derived components in aerosol form. Other examples include delivery devices for cannabinoids, such as Tetrahydrocannabinol (THC), Cannabidiol (CBD), and/or other cannabinoids, botanicals, medicinals, and/or other active ingredients.

Aerosol generating components of certain preferred aerosol delivery devices and/or vaporization devices may provide many of the sensations (e.g., inhalation and exhalation rituals, types of tastes or flavors, organoleptic effects, physical feel, use rituals, visual cues such as those provided by visible aerosol, and the like) of smoking a cigarette, cigar or pipe that is employed by lighting and burning tobacco (and hence inhaling tobacco smoke), without any substantial degree of combustion of any component thereof. For example, the user of an aerosol delivery device in accordance with some example embodiments of the present disclosure can hold and use that component much like a smoker employs a traditional type of smoking article, draw on one end of that piece for inhalation of aerosol produced by that piece, take or draw puffs at selected intervals of time, and the like.

While the systems are generally described herein in terms of embodiments associated with aerosol delivery devices and/or vaporization devices such as so-called "e-cigarettes" or "tobacco heating products," it should be understood that the mechanisms, components, features, and methods may be embodied in many different forms and associated with a variety of articles. For example, the description provided herein may be employed in conjunction with embodiments of traditional smoking articles (e.g., cigarettes, cigars, pipes, etc.), heat-not-burn cigarettes, and related packaging for any of the products disclosed herein. Accordingly, it should be understood that the description of the mechanisms, components, features, and methods disclosed herein are discussed in terms of embodiments relating to aerosol delivery devices by way of example only, and may be embodied and used in various other products and methods.

Aerosol delivery devices and/or vaporization devices of the present disclosure may also be characterized as being vapor-producing articles or medicament delivery articles. Thus, such articles or devices may be adapted so as to provide one or more substances (e.g., flavors and/or pharmaceutical active ingredients) in an inhalable form or state. For example, inhalable substances may be substantially in the form of a vapor (i.e., a substance that is in the gas phase at a temperature lower than its critical point). Alternatively, inhalable substances may be in the form of an aerosol (i.e., a suspension of fine solid particles or liquid droplets in a gas). For purposes of simplicity, the term "aerosol" as used herein is meant to include vapors, gases and aerosols of a form or type suitable for human inhalation, whether or not visible, and whether or not of a form that might be considered to be smoke-like. The physical form of the inhalable substance is not necessarily limited by the nature of the inventive devices but rather may depend upon the nature of the medium and the inhalable substance itself as to whether it exists in a vapor state or an aerosol state. In some embodiments, the terms "vapor" and "aerosol" may be interchangeable. Thus, for simplicity, the terms "vapor" and "aerosol" as used to describe aspects of the disclosure are understood to be interchangeable unless stated otherwise.

In some embodiments, aerosol delivery devices of the present disclosure may comprise some combination of a power source (e.g., an electrical power source), at least one control component (e.g., means for actuating, controlling, regulating and ceasing power for heat generation, such as by controlling electrical current flow from the power source to other components of the article—e.g., a microprocessor, individually or as part of a microcontroller), a heating member (e.g., an electrical resistance heating element or other component and/or an inductive coil or other associated components and/or one or more radiant heating elements), a liquid composition (e.g., commonly an aerosol precursor composition liquid capable of yielding an aerosol, such as ingredients commonly referred to as "smoke juice," "e-liquid" and "e-juice"), one or more forced-air components (e.g., a micro air pump, a micro-compressor, a microblower, a rotary micropump, and a diaphragm micropump), a liquid micropump (e.g., a rotary micropump, a pneumatic micropump, and a diaphragm micropump), at least one chamber configured to temporarily store a liquid composition, at least one reservoir configured to contain a liquid composition, and a mesh layer (e.g., a porous polymer mesh layer or mesh component for transferring a liquid composition). Note that it is possible to physically combine two or more of the above-noted components and/or to only include some of the above components to provide aerosol delivery devices as described herein. In light of the further description provided herein, it is evident that the present disclosure expressly encompasses any combination of any two, three, four, five, six, seven, eight, nine, or more of the foregoing components.

In various embodiments, a number of these components may be provided within an outer body or shell, which, in some embodiments, may be referred to as a housing. The overall design of the outer body or shell may vary, and the format or configuration of the outer body that may define the overall size and shape of the aerosol delivery device may vary. Although other configurations are possible, in some embodiments an elongated body resembling the shape of a cigarette or cigar may be formed from a single, unitary housing or the elongated housing can be formed of two or more separable bodies. For example, an aerosol delivery device may comprise an elongated shell or body that may be substantially tubular in shape and, as such, resemble the shape of a conventional cigarette or cigar. Other shapes and dimensions as further discussed below are also encompassed. In one example, all of the components of the aerosol delivery device are contained within one housing or body. In other embodiments, an aerosol delivery device may comprise two or more housings that are joined and are separable. For example, an aerosol delivery device may possess at one end a control unit having a housing containing one or more reusable components (e.g., an accumulator such as a rechargeable battery and/or rechargeable supercapacitor, and various electronics for controlling the operation of that article), and at the other end and removably coupleable thereto, an outer body or shell containing a disposable portion (e.g., a disposable flavor-containing aerosol source member).

Generally, an aerosol delivery device according to the present disclosure the aerosol delivery device may have a one-piece design (e.g., forming a singular body including all components of the device), a two-piece design (e.g., having two detachable sections), a three-piece design (e.g., having three detachable sections), or more. In multi-piece designs, for example, each detachable section can be permanently or detachably aligned in a functioning relationship. Various embodiments of engagement between these detachable sections may be employed such as a threaded engagement, a press-fit engagement, an interference fit, a magnetic engagement, or the like, including combinations of the foregoing. Typically, the components within each individual section and/or the arrangement of those components within each individual section may vary. In some embodiments, for example, various sections of the device and/or components within those sections may be considered to removable, replaceable, or reusable. In specific embodiments, the liquid composition may be located between two opposing ends of the device (e.g., within a reservoir of a cartridge, which in certain circumstances is replaceable and disposable or refillable). In some embodiments, the aerosol delivery device may have a three-piece design, for example, including a control unit having a housing containing one or more reusable components (e.g., an accumulator such as a rechargeable battery and/or rechargeable supercapacitor, and various electronics for controlling the operation of that article), a reservoir section having a housing containing one or more disposable components (e.g., a disposable and/or replaceable reservoir containing a liquid or aerosol precursor composition), and a third atomizer section having a housing containing one or more reusable components (e.g., one or more pumps, one or more chambers, and/or one or more mesh layers configured to generate an aerosol), wherein each of the three sections are removably coupleable to each other and arranged in a functioning relationship. Other configurations, however, are not excluded.

More specific formats, configurations and arrangements of various mesh layers, pumps, chambers, and components within aerosol delivery devices of the present disclosure will be evident in light of the further disclosure provided hereinafter. Additionally, the selection of various aerosol delivery device components may be appreciated upon consideration of the commercially available electronic aerosol delivery devices. Further, the arrangement of the components within the aerosol delivery device may also be appreciated upon consideration of the commercially available electronic aerosol delivery devices.

FIG. 1 illustrates an aerosol delivery device including a cartridge and a control unit wherein the cartridge and control unit are shown in a coupled configuration, according to an example embodiment of the present disclosure. In particular, FIG. 1 illustrates a perspective schematic view of an aerosol delivery device 100 including a cartridge 104 and a control unit 102. As depicted in the figure, the cartridge 104 may be permanently or detachably aligned in a functioning relationship with the control unit 102. Thus, the cartridge 104 and control unit 102 may be releasably engagable or may be configured for permanent connection. It should be noted that the components depicted in this and the further figures described herein are representative of the components that may be present in a control unit and/or cartridge and are not intended to limit the scope of the control unit and/or cartridge components that are encompassed by the present disclosure. Further, in some embodiments, aerosol delivery devices of the present disclosure may be provided in various configurations, such as in a two-piece configuration, a three-piece configuration, a four-piece configuration, and the like. In some embodiments, for example, any number of components of the aerosol delivery device may be described as being reusable or refillable as will be discussed herein. In some embodiments, the cartridge 104 and the control unit 102 may be completely reusable, including the components thereof, for example, the reservoir may be provided as a completely separate component that is replaceable or refillable by a user.

FIG. 2 illustrates a front cross-section schematic view of the aerosol delivery device 100, wherein the cartridge 104 and control unit 102 of FIG. 1 are shown in a de-coupled configuration. In various embodiments, the aerosol delivery device 100 may have a variety of different shapes. For example, in some embodiments (such as the depicted embodiment) the aerosol delivery device 100 may be substantially rod-like or substantially tubular shaped or substantially cylindrically shaped. In other embodiments, however, other shapes and dimensions are possible (e.g., rectangular, oval, hexagonal, prismatic, regular or irregular polygon shapes, disc-shaped, cube-shaped, multifaceted shapes, or the like). In still other embodiments, the cartridge and the control unit may independently have different shapes.

In the depicted embodiment, the control unit 102 and the cartridge 104 include components adapted to facilitate mechanical engagement therebetween. Although a variety of other configurations are possible, the control unit 102 of the depicted embodiment includes a coupler 124 that defines a cavity 125 therein. Likewise, the cartridge 104 includes a base 140 adapted to engage the coupler 124 of the control unit 102. A coupler and a base that may be useful according to the present disclosure are described in U.S. Pat. App. Pub. No. 2014/0261495 to Novak et al., the disclosure of which is incorporated herein by reference in its entirety.

It should be noted, however, that in other embodiment various other structures, shapes, and/or components may be employed to couple the control unit and the cartridge. For example, in some embodiments the control unit and cartridge may be coupled together via an interference or press fit connection such as, for example, embodiments wherein the control unit includes a chamber configured to receive at least a portion of the cartridge or embodiments wherein the cartridge includes a chamber configured to receive at least a portion of the control unit. In other embodiments, the cartridge and the control unit may be coupled together via a screw thread connection. In still other embodiments, the cartridge and the control unit may be coupled together via a bayonet connection. In still other embodiments, the cartridge and the control unit may be coupled via a magnetic connection. In various embodiments, once coupled an electrical connection may be created between the cartridge and the control unit so as to electrically connect the cartridge (and components thereof) to the battery and/or via the control component of the control unit. Such an electrical connection may exist via one or more components of the coupling features. In such a manner, corresponding electrical contacts in the cartridge and the control unit may be substantially aligned after coupling to provide the electrical connection.

In specific embodiments, one or both of the control unit 102 and the cartridge 104 may be referred to as being disposable or as being reusable. For example, in some embodiments the control unit may have a replaceable battery or a rechargeable battery and thus may be combined with any type of recharging technology, including connection to a wall charger, connection to a car charger (e.g., cigarette lighter receptacle, USB port, etc.), connection to a computer, any of which may include a universal serial bus (USB) cable or connector (e.g., USB 2.0, 3.0, 3.1, USB Type-C), connection to a USB connector (e.g., USB 2.0, 3.0, 3.1, USB Type-C as may be implemented in a wall outlet, electronic device, vehicle, etc.), connection to a photovoltaic cell (sometimes referred to as a solar cell) or solar panel of solar cells, or wireless charger, such as a charger that uses inductive wireless charging (including for example, wireless charging according to the Qi wireless charging standard from the Wireless Power Consortium (WPC)), or a wireless radio frequency (RF) based charger, and connection to an array of external cell(s) such as a power bank to charge a device via a USB connector or a wireless charger. An example of an inductive wireless charging system is described in U.S. Pat. App. Pub. No. 2017/0112196 to Sur et al., which is incorporated herein by reference in its entirety. In further embodiments, a power source may also comprise a capacitor. Capacitors are capable of discharging more quickly than batteries and can be charged between puffs, allowing the battery to discharge into the capacitor at a lower rate. For example, a supercapacitor—e.g., an electric double-layer capacitor (EDLC)—may be used separate from or in combination with a battery. When used alone, the supercapacitor may be recharged before each use of the article. Thus, the device may also include a charger component that can be attached to the smoking article between uses to replenish the supercapacitor. Examples of power supplies that include supercapacitors are described in U.S. Pat. App. Pub. No. 2017/0112191 to Sur et al., which is incorporated herein by reference in its entirety.

As illustrated in FIG. 2, the control unit 102 may be formed of a control unit housing 101 that includes at least one control component 106 (e.g., a printed circuit board (PCB), an integrated circuit, a memory component, a microcontroller, or the like), a flow sensor 108, a battery 110, and a light-emitting diode (LED) 112, which components may be variably aligned. Some example types of electronic components, structures, and configurations thereof, features thereof, and general methods of operation thereof, are described in U.S. Pat. No. 4,735,217 to Gerth et al.; U.S. Pat. No. 4,947,874 to Brooks et al.; U.S. Pat. No. 5,372,148 to McCafferty et al.; U.S. Pat. No. 6,040,560 to Fleischhauer et al.; U.S. Pat. No. 7,040,314 to Nguyen et al. and U.S. Pat. No. 8,205,622 to Pan; U.S. Pat. App. Pub. Nos. 2009/0230117 to Fernando et al., 2014/0060554 to Collet et al., and 2014/0270727 to Ampolini et al.; and U.S. Pat. App. Pub. No. 2015/0257445 to Henry et al.; which are incorporated herein by reference in their entireties. Some examples of batteries that may be applicable to the present disclosure are described in U.S. Pat. App. Pub. No. 2010/0028766 to Peckerar et al., the disclosure of which is incorporated herein by reference in its entirety. In some embodiments, further indicators (e.g., a haptic feedback component, an audio feedback component, or the like) may be included in addition to or as an alternative to the LED. Additional representative types of components that yield visual cues or indicators, such as light emitting diode (LED) components, and the configurations and uses thereof, are described in U.S. Pat. No. 5,154,192 to Sprinkel et al.; U.S. Pat. No. 8,499,766 to Newton and U.S. Pat. No. 8,539,959 to Scatterday; U.S. Pat. App. Pub. No. 2015/0020825 to Galloway et al.; and U.S. Pat. App. Pub. No. 2015/0216233 to Sears et al.; which are incorporated herein by reference in their entireties. It should be understood that in various embodiments not all of the illustrated elements may be required. For example, in some embodiments an LED may be absent or may be replaced with a different indicator, such as a vibrating indicator. Likewise, a flow sensor may be replaced with a manual actuator, such as, for example, one or more manually actuated push buttons.

In the depicted embodiment, the control unit housing 101 includes an air intake 114, which may comprise an opening in the housing proximate the coupler 124 allowing for passage of ambient air into the control unit housing 101 where it then passes through the cavity 125 of the coupler 124, and eventually over or around a mesh layer 122, where it may be mixed with a liquid composition to form an aerosol that is delivered to the user. It should be noted that in other embodiments the air intake 114 is not limited being on or adjacent the control unit housing 101. For example, in some embodiments, an air intake may be formed through the cartridge housing 103 (e.g., such that it does not enter the control unit 102) or some other portion of the aerosol delivery device 100. In the depicted embodiment, a mouthpiece portion that includes an opening 128 may be present in the cartridge housing 103 (e.g., at a mouthend of the cartridge 104) to allow for egress of the formed aerosol from the cartridge 104, such as for delivery to a user drawing on the mouthend of the cartridge 104. In some embodiments, for example, the cartridge 104 may be configured to be at least partially inserted into a cavity formed in the control unit housing 102, and the components may be sized such that air may pass between the cartridge housing 103 and the control unit housing 101 to pass through an opening at the end of the cartridge housing 103.

Although in the depicted embodiment the control component 106 and the flow sensor 108 are illustrated separately, it should be noted that in some embodiments the control component and the flow sensor may be combined as an electronic circuit board with the air flow sensor attached directly thereto. In some embodiments, the aerosol delivery device may include more than one control component, each control component being configured to control one or more functionalities within the aerosol delivery device, for example. In some embodiments, the air flow sensor may comprise its own circuit board or other base element to which it can be attached. In some embodiments, a flexible circuit board may be utilized. A flexible circuit board may be configured into a variety of shapes, include substantially tubular shapes. Configurations of a printed circuit board and a pressure sensor, for example, are described in U.S. Pat. App. Pub. No. 2015/0245658 to Worm et al., the disclosure of which is incorporated herein by reference. Additional types of sensing or detection mechanisms, structures, and configuration thereof, components thereof, and general methods of operation thereof, are described in U.S. Pat. No. 5,261,424 to Sprinkel, Jr.; U.S. Pat. No. 5,372,148 to McCafferty et al.; and PCT WO 2010/003480 to Flick; which are incorporated herein by reference in their entireties.

As depicted in FIG. 2, in some embodiments the cartridge 104 may be formed of a cartridge housing 103 with an air pathway 126 extending at least partially therethrough. Aerosol delivery devices of the present disclosure may also comprise a reservoir 116 configured to contain a content of a liquid composition, an intermediate chamber 118 configured to temporarily store a fractional content of the liquid composition, a micropump 120 interconnecting the reservoir 116 and the intermediate chamber 118 and configured to deliver the fractional content of the liquid composition from the reservoir 116 to the intermediate chamber 118 under pressure, and a mesh layer 122 positioned at least partially between the intermediate chamber 118 and the air pathway 126, the mesh layer 122 being adapted to transfer the liquid composition received from the intermediate chamber 118 into the air pathway 126 forming an aerosol.

Generally, the components of the disclosed aerosol delivery devices are configured relative to one another so that the mesh layer is positioned at least partially between the intermediate chamber and the air pathway, such that the mesh layer is adapted to transfer the liquid composition received from the intermediate chamber into the air pathway forming an aerosol (e.g., small particles of the liquid composition on the surface of the mesh layer become entrained within air passing through the air pathway, thus forming an aerosol/vapor composition). However, arrangement of these specific components within the aerosol delivery device may vary. When the small particles of the liquid composition mix with air, either via a user drawing on the device or via a forced-air component, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof.

As noted above, in some embodiments, the cartridge may comprise a reservoir 116 configured to contain a content of a liquid composition. The liquid reservoir of the depicted embodiment may be in fluid communication with (either directly or through one or more additional components) the liquid micropump. As will be discussed in more detail below, in some embodiments, the liquid reservoir may comprise an independent container (e.g., formed of walls substantially impermeable to the liquid composition), which, in some embodiments, may be configured to be removed, replaced, and/or refilled by a user of the device. In other embodiments, the reservoir may not be included within the cartridge and, instead, the reservoir may be entirely self-contained in a housing separate from the cartridge and the control unit (e.g., such as in an aerosol delivery device having a three-piece design). In some embodiments, the walls of the liquid reservoir may be flexible and/or collapsible, while in other embodiments the walls of the liquid reservoir may be substantially rigid. In some embodiments, the liquid reservoir may be substantially sealed to prevent passage of the liquid composition therefrom except via any specific openings or conduits provided expressly for passage of the liquid composition, such as through one or more transport elements as otherwise described herein.

As noted above, the cartridge 104 may further comprise an intermediate chamber 118 configured to temporarily store a fractional content of the liquid composition. In the depicted embodiment, the intermediate chamber is in connection with the mesh layer 122 (e.g., via direct contact or close proximity such that the fractional content of the liquid composition can be freely transferred from the intermediate chamber to mesh layer). In some embodiments, the intermediate chamber may have a substantially thin, flat disk-like shape. However, in other embodiments, other shapes are possible, including, for example, a substantially hollow cylindrical shape, a substantially hollow rectangular shape, a substantially hollow cuboidal shape, or any other regular or irregular shape. The shape of the intermediate chamber may vary, but generally the intermediate chamber will be small enough to contain only the fractional content of the liquid composition. For example, in some embodiments, the intermediate chamber may be sufficiently small to contain only the volume of the liquid composition required for one puff. Generally, the volume of liquid required for one puff may vary based on use of the device (e.g., based on puff duration by a user). In some embodiments, for example, the intermediate chamber may be of sufficient size to contain the volume of the liquid composition required for a puff duration of at least 1 second, at least 2 seconds, at least 3 seconds, at least 4 seconds, at least 5 seconds, at least 6 seconds, at least 7 seconds, at least 8 seconds, at least 9 seconds, at least 10 seconds, or more. In some embodiments, the intermediate chamber may have a volume capacity that is slightly less than the volume of the liquid composition required for one puff. The intermediate chamber of the depicted embodiment may be in fluid communication with (either directly or through one or more additional components) the liquid micropump. Further, in some embodiments such as the one depicted in FIG. 3, the cartridge 104 may have a second chamber 130 that is in connection with the intermediate chamber 118 and is fluidly connected to the reservoir 116. The second chamber of the depicted embodiment may be in fluid communication with (either directly or through one or more additional components) the liquid micropump 120 and the intermediate chamber 118. The second chamber can be configured to be in various shapes, including, for example, a substantially disk-like shape, a substantially hollow cylindrical shape, a substantially hollow rectangular shape, a substantially hollow cuboidal shape, or any other shape configured to contain a liquid composition.

In the depicted embodiment, the cartridge 104 further includes a micropump 120 interconnecting the reservoir 116 and the intermediate chamber 118 and configured to deliver the fractional content of the liquid composition from the reservoir 116 to the intermediate chamber 118 under pressure. Suitable liquid pumps may include, but are not limited to, a centrifugal micropump, a ring micropump, a rotary micropump, a diaphragm micropump, a peristaltic micropump, and a step micropump. The micropump of the depicted embodiment may be in fluid communication with (either directly or through one or more additional components) the reservoir 116 and the intermediate chamber 118 (referring to FIG. 2) and/or the second chamber 130 (referring to FIG. 3). In some embodiments, the cartridge may include multiple micropumps, for example, such as a first micropump interconnecting the reservoir 116 and the second chamber 130 and a second micropump interconnecting the second chamber 130 and the intermediate chamber 118 (not pictured).

As noted previously, various components within the cartridge may be in fluid communication with each other either directly or indirectly by way of one or more liquid transport elements. As illustrated in FIG. 2 and FIG. 3, the dashed lines provided in the cartridge 104 indicate interconnecting of components within the cartridge, for example, through direct or indirect connection (e.g., such as via a conduit or transport element). It should be noted that these dashed lines may represent direct connection between all components within the cartridge, indirect connection between all components within the cartridge, or any combination of direct and indirect connection of components within the cartridge. For example, in some embodiments the reservoir 116 may be in fluid communication with a first liquid transport element 150 that is in fluid communication with the liquid micropump 120. The first liquid transport element can transport the content of the liquid composition stored in the reservoir 116 to the micropump 120. In such a manner, a second liquid transport element 152 is configured to facilitate transfer of the content of the liquid composition to the intermediate chamber 118. Thus, providing fluid communication between the reservoir 116 and the intermediate chamber 118 (referring to FIG. 2) or between the reservoir 116 and the second chamber 130 (referring to FIG. 3). Further, in the embodiment depicted in FIG. 3, a third liquid transport element 154 can transport a fractional content of the liquid composition stored in the second chamber 130 to the intermediate chamber 118. Thus, providing fluid communication between the second chamber 130 and the intermediate chamber 118. In some embodiments, the liquid transport elements may be in the form of hollow tubing capable of transporting a pressurized flow of the liquid composition. Other example embodiments of reservoirs and transport elements useful in aerosol delivery devices according to the present disclosure may vary, and such reservoirs and/or transport elements can be incorporated into devices such as those described herein. Examples of useful reservoirs and transport elements for use in embodiments of the present disclosure can be found, for example, in U.S. Pat. No. 9,839,237 to Chang et al.; U.S. Pat. No. 10,015,989 to Davis et al.; and U.S. Pat. No. 10,034,494 to Ampolini et al.; each of which are incorporated herein by reference in their entireties.

In some embodiments, a microfluidic chip may be embedded in the reservoir 116, and the amount and/or mass of liquid composition delivered from the reservoir may be controlled by the micropump, such as one based on microelectromechanical systems (MEMS) technology. In some embodiments, the liquid micropump may be directly connected to the reservoir and/or the intermediate chamber, for example, such that liquid is pumped directly from the reservoir via the micropump to the intermediate chamber, whereby use of one or more transport elements is not necessary. In some embodiments, the micropump may be positioned within the reservoir such that the micropump and the reservoir form a single component within the cartridge. Examples of suitable micropumps for use in embodiments of the present disclosure can be found, for example in U.S. patent application Ser. No. 16/203,069, directed to Micropump for an Aerosol Delivery Device, filed on Nov. 28, 2018; as well as U.S. Pat. No. 10,285,451 to Bless, both of which are incorporated herein by reference in their entireties.

In various embodiments, it may be advantageous to facilitate contact (e.g., maintain or encourage contact) between the liquid composition and the air drawn through the air pathway 126. Along those lines, FIG. 4 illustrates a side schematic view of an intermediate chamber 118 containing a fractional content of liquid composition 204 and a mesh layer 122 configured to generate an aerosol from the liquid composition upon contact of the liquid droplets with the drawn air, according to an example embodiment of the present disclosure. Generally, the intermediate chamber 118 includes an interior space 206 capable of temporarily storing the fractional content of the liquid composition 204. In various embodiments, the mesh layer 122 may have a variety of different shapes and/or configurations. As depicted in FIG. 4, the mesh layer 122 typically has an inner surface or a contacting surface 208 proximal to the interior space that is in contact with the liquid composition and an outer surface 210. For example, in some embodiments the mesh layer may substantially linear (e.g., such that the mesh layer has a substantially flat profile). In other embodiments, such as the embodiment depicted in FIG. 4, the mesh layer may be substantially curved (e.g., such that the mesh layer has a curved profile). In such embodiments, for example, the mesh layer may be concave or convex with respect to the interior space of the intermediate chamber. Generally, the mesh layer may be made of a variety of different materials.

In some embodiments, the mesh layer may be made of a metal material, such as, but not limited to, stainless steel, palladium-nickel, or titanium. In other embodiments, the mesh layer may be made of a polymeric material, such as, for example, a polyimide polymer. The types of metals and/or polymer materials forming the mesh layer may vary and generally any metal or polymer-type material would be suitable for forming a mesh layer according to the present disclosure. In still other embodiments, the mesh layer may be made of a combination of materials.

In some embodiments, the mesh layer may optionally be formed of a high surface energy material. For example, in some embodiments, the materials forming the mesh layer themselves may be characterized as high surface energy materials (e.g., metal materials) or the mesh layer may be treated to increase the surface energy of the mesh material when the mesh material itself is not of sufficient surface energy (e.g., low-surface energy polymer materials). In some embodiments, for example, the inner surface of the mesh layer (e.g., the surface contacting the intermediate chamber) may be treated with a thin film coating of high surface energy materials. High surface energy coatings may include, but are not limited to: metal-based coatings, glass-based coatings, acid-based coatings (e.g., such as a chromic acid coating), and the like. Generally, the methods used for increasing the surface energy of the inner surface of the mesh layer may vary and any method or material known to increase the surface energy of a material may be suitable. For example, in some embodiments the surface energy of the inner surface of the mesh layer may be increased by application of ultraviolet (UV) light and/or thermal treatment. It should be noted that use of high surface energy mesh materials and coatings thereon, particularly on the inner surface of the mesh layer, can advantageously provide increased interaction between the mesh layer and the liquid composition contained within the intermediate chamber, thus allowing the mesh layer to be easily wetted by the liquid.

In some embodiments, the mesh layer may optionally be heated. Application of heat to the mesh layer can advantageously provide a heated mesh layer exhibiting an increased surface energy as compared to a non-heated mesh layer, which may make it easier to generate an aerosol when a user draws on the device (e.g., by reducing the liquid surface tension in the intermediate chamber and/or promoting smaller particle sizes of the liquid composition as it passes through the heated mesh layer). Generally, heat may be applied to the mesh layer in a variety of ways. In some embodiments, the aerosol delivery device may include a separate heating component in connection with the mesh layer and configured to heat the mesh layer (e.g., as discussed with respect to FIG. 5). In such embodiments, the heating component may be in the form of a coil heating component, a ceramic heating component, an electrical heating component, a heating wire, and/or any heating element generally known in the art that would be suitable for transferring heat to the mesh layer. While this separate heating component is discussed with respect to the embodiment depicted in FIG. 5, it should be noted that a separate heating component may be used in various other embodiments as discussed herein, e.g., such as the embodiments depicted in FIGS. 2 and 3. In other embodiments, for example when the mesh layer is formed of metal material having an electrical resistance, a current may be applied directly to the mesh layer to heat the mesh layer. In such embodiments, for example, the control component may be configured to direct an electrical current flow from the power source to the mesh layer to heat the mesh layer. In such embodiments, the mesh layer may be in electrical connection with the control component and/or the power source to facilitate heating of the mesh layer.

In some embodiments, a hydrophobic or low surface energy coating may optionally be applied to the exterior surface of the mesh layer (e.g., the surface contacting the air pathway) to prevent liquid droplets from sticking to the exterior surface of the mesh layer. Such a configuration may advantageously improve aerosol generation efficiency. Various materials and coatings having low surface energy properties are commonly known in the art and, generally, any method, material, or coating known to reduce the surface energy of a material may be suitable for application to the exterior of the mesh layer.

In some embodiments, the aerosol delivery device may optionally comprise a piezoelectric ring or disk that may be positioned between the mesh layer and the intermediate chamber. In some embodiments, for example, the piezoelectric ring may be formed of a piezoelectric material (e.g., a piezoelectric ceramic material). A variety of different piezoelectric materials are possible, including natural or synthetic materials. Some non-limiting examples of natural piezoelectric materials include, for example, quartz, berlinite ($AlPO_4$), sucrose, rochelle salt, topaz, tourmaline-group minerals, lead titanate ($PbTiO_3$), and collagen. Some non-limiting examples of synthetic materials include, for example, a ($La_3Ga_5SiO_{14}$), gallium phosphate, gallium orthophosphate ($GaPO_4$), lithium niobate ($LiNbO_3$), lithium tantalate ($LiTaO_3$), AlN, ZnO, barium titanate ($BaTiO_3$), lead zirconate titanate ($Pb[Zr_xTi_{1-x}]O_3$) (a.k.a. PZT), potassium niobate ($KNbO_3$), sodium tungstate ($Na_2WO_3$), $Ba_2NaNb_5O_5$, $Pb_2KNb_5O_{15}$, zinc oxide (ZnO), sodium potassium niobate ($(K,Na)NbO_3$) (a.k.a. NKN), bismuth ferrite ($BiFeO_3$), sodium niobate $NaNbO_3$, barium titanate ($BaTiO_3$), bismuth titanate $Bi_4Ti_3O_{12}$, sodium titanate, and sodium bismuth titanate $NaBi(TiO_3)_2$. In other embodiments, polymers exhibiting piezoelectric characteristics may be used, including, but not limited to, polyvinylidene fluoride (PVDF).

In some embodiments, such as the embodiment depicted in FIG. 4, the mesh layer 122 includes a plurality of openings or perforations 200 extending through the mesh layer from the inner surface 208 to the outer surface 210 of the mesh layer. In some embodiments, the openings may be defined by substantially circular openings in the surfaces of the mesh layer (i.e., when viewed normal to the surface of the mesh layer, the plurality of openings have a shape that is substantially circular). In other embodiments, the plurality of openings may be defined by non-circular openings in the surfaces of the mesh layer, such as, for example, oval, rectangular, triangular, conical, and regular or irregular polygon shapes when viewed normal to the surface of the mesh layer. In various embodiments, the openings may be created using a variety of different methods, including, but not limited to, via a laser (e.g., a femtosecond laser) or via electroplating (e.g., lithography) or via use of high or low energy ion or electron beams.

In various embodiments, the shapes defined through the mesh layer by the plurality of openings (i.e., when viewed in cross-section as depicted in the circular cutout of the mesh layer in FIG. 4) may vary. For example, in some embodiments the shapes defined through the mesh layer by the plurality of openings may be substantially cylindrical, conical, rectangular, and various other regularly or irregularly shaped three dimension figures. In the depicted embodiment, the shapes defined through the mesh layer 122 by the plurality of openings 200 may be substantially conical (e.g., having a truncated conical shape defining smaller openings on the outer surface of the mesh layer and larger openings on the inner surface of the mesh layer). In other embodiments, the shapes defined through the mesh layer by the plurality of openings may be tetragonal or pyramidal. Without intending to be bound by such a theory, it is believed that in some embodiments substantially conical shapes may increase the performance of the mesh layer in atomizing the liquid composition. Although any orientation of the mesh layer may be used, in embodiments having the plurality of openings defining substantially conical shapes through the mesh layer, the smaller side of the conical openings may be positioned proximate to the air pathway side of the mesh layer and the larger side of the conical openings may be positioned proximate to the interior space of the intermediate chamber.

In the depicted embodiment having the plurality of openings defining substantially conical cross-sectional shapes, the smaller side 201 of the plurality of openings may have a size in the range of approximately 0.1 microns to approximately 10 microns, or in the range of approximately 0.5 microns to approximately 5 microns, or in the range of approximately 1 micron to approximately 3 microns. In some embodiments, the larger side 202 of the plurality of openings 200 may have a size in the range of approximately 2 microns to approximately 100 microns, or in the range of approximately 5 microns to approximately 75 microns, or in the range of approximately 10 microns to approximately 50 microns. In some embodiments, the size of the openings may be substantially uniform across substantially the entire area defined by the mesh layer; however, in other embodiments, the size of the openings may vary in different portions of the area defined by the mesh layer. For example, the mesh layer may include a first section having openings of a first average size range and may include a second section or further sections having openings of a second average size range or further average size ranges. The sections of specific size ranges may be specifically located across the area defined by the mesh layer or may be randomly spaced. In such a manner, the formed aerosol may have different size aerosol droplets. In various embodiments, the mesh layer may have any number of openings. In some embodiments, for example, a number of openings in the mesh layer may be in the range of approximately 200 to approximately 6,000, or in the range of approximately 400 to approximately 4,000, or in the range of approximately 200 to approximately 2,000. In various embodiments, the thickness of the mesh layer may vary. For example, in some embodiments the thickness of the mesh layer may be in the range of about 0.1 microns to about 10 mm, or about 1 micron to about 5 mm, or about or about 10 microns to about 1 mm.

In some embodiments, the mesh layer 122 may be in contact with at least a portion of a liquid composition 204 in the intermediate chamber 118, and/or may be proximate at least a portion of a liquid composition 204 in the immediate chamber 118, and/or may receive at least a portion of a liquid composition 204 from the intermediate chamber 118. As noted above, the fractional content of the liquid composition (e.g., referred to as the liquid composition 204 in FIG. 4) is delivered to the intermediate chamber via the micropump and the fractional content of the liquid composition may have a volume that is slightly greater than the volume capacity of the intermediate chamber. In such embodiments, the pressure exerted on the intermediate chamber 118 (e.g., due to the volume of the liquid composition being greater than the volume capacity of the intermediate chamber) causes at least a portion of the liquid composition 204 in the intermediate chamber 118 to penetrate into the plurality of openings 200 in the mesh layer 122 and pass through the mesh layer creating a plurality of micro-droplets of the liquid composition on the external surface of the mesh layer (e.g., the surface of the mesh layer positioned proximate the air pathway 126, referring back to FIG. 2 and FIG. 3). In such a manner, as air is drawn through the air pathway 126, facilitated by a drawing force applied by a user or via a forced-air component, the plurality of liquid droplets formed on the external surface of the mesh layer 122 are mixed with the drawn air to generate an aerosol. Generally, the amount of pressure exerted on the intermediate chamber 118 (e.g., due to the volume of the liquid composition being greater than the volume capacity of the intermediate chamber), and ultimately the amount of aerosol delivered in a single puff, is controlled based on the amount of liquid composition transported to the intermediate chamber 118 via the micropump 120. For example, the micropump controls the amount of liquid composition delivered to the intermediate chamber upon activation of the device and thus, the amount of aerosol delivered to a user of the device may be varied by altering the output of the micropump.

In some embodiments, such as the depicted embodiment in FIG. 2, when a user draws on the device 100, airflow may be detected by the sensor 108, and the micropump 120 may be activated, which may convert the liquid composition into a plurality of micro-droplets as noted above. In some embodiments, drawing upon the mouthend of the device 100 causes ambient air to enter the air intake 114 and pass through the cavity 125 in the coupler 124 and the base 140. In the cartridge 104, the drawn air combines with the plurality of micro-droplets in the air pathway to form the aerosol. The aerosol is whisked, aspirated, or otherwise drawn away from the mesh layer 122 and out of the mouth opening 128 in the mouthend of the article 100. As noted, in other embodiments, in the absence of an airflow sensor, the micropump 120 may be activated manually, such as by a push button or other input element. Additionally, in some embodiments, the air intake may occur through the cartridge or between the cartridge and the control unit.

In some embodiments, aerosol delivery devices of the present disclosure may further comprise a forced-air component. In some embodiments the forced-air component may be provided in variety of forms, for example, micropumps, microblowers, and/or air compressors. Suitable forced-air components may include, but are not limited to, a micro-compressor pump, a micro-blower, a rotary micropump, a diaphragm micropump, an air compressor, and a piezoceramic micropump. As noted above, referring to FIG. 3, aerosol delivery devices according to the present disclosure may comprise an air intake 114 configured to receive ambient air within the aerosol delivery device. In some embodiments, a forced-air component 132 may be in fluid communication with the air intake 114 such that air is drawn into the forced-air component 132 from outside of the aerosol delivery device when the forced-air component 132 is activated. As noted above regarding the liquid micropump, the forced-air component may be activated by the airflow sensor and/or activated manually, such as by a push button or an input element operated by a user of the aerosol delivery device. In addition, the forced-air component 132 may further comprise a filter component configured to reduce the amount of particulates that accumulate inside the forced-air component 132.

In some embodiments, the aerosol delivery device may further comprise an input element 134 (e.g., as shown in FIG. 3) configured to be operated by a user of the aerosol delivery device and in communication with the control component 106. In some embodiments, the control component 106 may be in electrical communication with the micropump 120 and configured to control the amount of the liquid composition transferred to the intermediate chamber 118 by the micropump 120. In some embodiments, the input element 134 may be configured as an electronic display allowing a user to adjust the amount of nicotine delivered per puff and/or to adjust the amount of total particulate matter (TPM) released per puff, for example, by adjusting the rate of liquid transfer from the reservoir to the intermediate chamber via the micropump. In some embodiments, the input element may replace or supplement an airflow sensor, pressure sensor, or manual push button. In various embodiments, an input element may be included to allow a user to control other functions of the device and/or for output of information to a user. For example, in some embodiments, the aerosol delivery device may include a second control component in communication with the input element and the power source. In such embodiments, the second control component may be configured to control the power output from the power source (e.g., such that a user can activate or deactivate the aerosol delivery device via the input element). Any component or combination of components may be utilized as an input for controlling the function of the device. For example, one or more pushbuttons may be used as described in U.S. Pat. App. Pub. No. 2015/0245658 to Worm et al., which is incorporated herein by reference in its entirety. Likewise, a touchscreen may be used as described in U.S. patent application Ser. No. 14/643,626, filed Mar. 10, 2015, to Sears et al., which is incorporated herein by reference in its entirety. As a further example, components adapted for gesture recognition based on specified movements of the aerosol delivery device may be used as an input. See U.S. App. Pub. No. 2016/0158782 to Henry et al., which is incorporated herein by reference in its entirety. As still a further example, a capacitive sensor may be implemented on the aerosol delivery device to enable a user to provide input, such as by touching a surface of the device on which the capacitive sensor is implemented.

In some embodiments, an input element may comprise a computer or computing device, such as a smartphone or tablet. In particular, the aerosol delivery device may be wired to the computer or other device, such as via use of a USB cord or similar protocol. The aerosol delivery device also may communicate with a computer or other device acting as an input via wireless communication. See, for example, the systems and methods for controlling a device via a read request as described in U.S. Pat. App. Pub. No. 2016/0007561 to Ampolini et al., the disclosure of which is incorporated herein by reference in its entirety. In such embodiments, an APP or other computer program may be used in connection with a computer or other computing device to input control instructions to the aerosol delivery device, such control instructions including, for example, the ability to form an aerosol of specific composition by choosing the nicotine content and/or content of further flavors to be included, the ability to control the amount of the liquid composition transferred from the reservoir to the intermediate chamber via the micropump to allow a user to customize the puff volume/duration of a single puff and/or the nicotine content in a single puff and/or the amount of total particulate matter (TPM) released per puff. As noted above, the volume of liquid delivered to the intermediate chamber (via the micropump) is generally proportional to the amount of aerosol delivered to a user in a single puff and, as such, a user may customize the specific puff duration and/or puff strength (e.g., based on the nicotine content delivered to the user) via the input element having a customizable user interface and/or via an external device (e.g., such as a cell phone or other computing devices and applications) in communication with the input element.

Yet other features, controls or components that may be incorporated into aerosol delivery systems of the present disclosure are described in U.S. Pat. No. 5,967,148 to Harris et al.; U.S. Pat. No. 5,934,289 to Watkins et al.; U.S. Pat. No. 5,954,979 to Counts et al.; U.S. Pat. No. 6,040,560 to Fleischhauer et al.; U.S. Pat. No. 8,365,742 to Hon; U.S. Pat. No. 8,402,976 to Fernando et al.; U.S. Pat. App. Pub. Nos. 2010/0163063 to Fernando et al.; 2013/0192623 to Tucker et al.; 2013/0298905 to Leven et al.; 2013/0180553 to Kim et al., 2014/0000638 to Sebastian et al., 2014/0261495 to Novak et al., and 2014/0261408 to DePiano et al.; which are incorporated herein by reference in their entireties.

In some embodiments, the liquid composition may be in the form of an aerosol precursor composition. In some embodiments, the aerosol precursor composition, sometimes referred to as an aerosol precursor composition or a vapor precursor composition or "e-liquid", may comprise a variety of components, which may include, by way of example, a polyhydric alcohol (e.g., glycerin, propylene glycol, or a mixture thereof), nicotine, tobacco, tobacco extract, and/or flavorants. Representative types of aerosol precursor components and formulations are also set forth and characterized in U.S. Pat. No. 7,217,320 to Robinson et al. and U.S. Pat. App. Pub. Nos. 2013/0008457 to Zheng et al.; 2013/0213417 to Chong et al.; 2014/0060554 to Collett et al.; 2015/0020823 to Lipowicz et al.; and 2015/0020830 to Koller, as well as WO 2014/182736 to Bowen et al, the disclosures of which are incorporated herein by reference in their entireties. Other aerosol precursors that may be employed include the aerosol precursors that have been incorporated in VUSE® products by R. J. Reynolds Vapor Company, the BLU™ products by Fontem Ventures B. V., the MISTIC MENTHOL product by Mistic Ecigs, MARK TEN products by Nu Mark LLC, the JUUL product by Juul Labs, Inc., and VYPE products by CN Creative Ltd. Also desirable are the so-called "smoke juices" for electronic cigarettes that have been available from Johnson Creek Enterprises LLC. Still further example aerosol precursor compositions are sold under the brand names BLACK NOTE, COSMIC FOG, THE MILKMAN E-LIQUID, FIVE PAWNS, THE VAPOR CHEF, VAPE WILD, BOOSTED, THE STEAM FACTORY, MECH SAUCE, CASEY JONES MAINLINE RESERVE, MITTEN VAPORS, DR. CRIMMY'S V-LIQUID, SMILEY E LIQUID, BEANTOWN VAPOR, CUTTWOOD, CYCLOPS VAPOR, SICBOY, GOOD LIFE VAPOR, TELEOS, PINUP VAPORS, SPACE JAM, MT. BAKER VAPOR, and JIMMY THE JUICE MAN.

The amount of aerosol precursor that is incorporated within the aerosol delivery device is such that the aerosol generating device provides acceptable sensory and desirable performance characteristics. For example, some embodiments utilize aerosol precursor having sufficient amounts of aerosol forming material (e.g., glycerin and/or propylene glycol) to provide for the generation of a visible mainstream aerosol that in many regards resembles the appearance of tobacco smoke. The amount of aerosol precursor within the aerosol generating system may be dependent upon factors such as the number of puffs desired per aerosol generating device. In one or more embodiments, about 1 ml or more, about 2 ml or more, about 5 ml or more, or about 10 ml or more of the aerosol precursor composition may be included.

In the some of the examples described above, the aerosol precursor composition comprises a glycerol-based liquid. In other embodiments, however, the aerosol precursor composition may be a water-based liquid. In some embodiments, the water-based aerosol precursor composition may be comprised of more than approximately 60% water. For example, in some embodiments, the water-based aerosol precursor composition may in include about 60% or greater water by weight, or about 65% or greater water by weight, or about 70% or greater water by weight, or about 75% or greater water by weight, or about 80% or greater water by weight, or about 85% or greater water by weight, or about 90% or greater water by weight, based on the total weight of the water-based aerosol precursor composition. In some embodiments, the water-based liquid may include up to approximately 10% propylene glycol. For example, in some embodiments the percentage of propylene glycol in the water-based liquid may be in the range of approximately 4% to approximately 5%. In some embodiments, the water-based liquid may include up to approximately 10% flavorant. For example, in some embodiments the percentage of flavorant(s) of the water-based liquid may be in the range of approximately 3% to approximately 7%. In some implementations, the water-based liquid may include up to approximately 1% nicotine. For example, in some embodiments the percentage nicotine in the water-based liquid may be in the range of approximately 0.1% to approximately 0.3%. In some embodiments, the water-based liquid may include up to approximately 10% cyclodextrin. For example, in some embodiments the percentage cyclodextrin in the water-based liquid may be in the range of approximately 3% to 5%. In still other embodiments, the aerosol precursor composition may be a combination of a glycerol-based liquid and a water-based liquid. For example, some embodiments may include up to approximately 50% water and less than approximately 20% glycerol. The remaining components may include one or more of propylene glycol, flavorants, nicotine, cyclodextrin, etc. Some examples of water-based liquid compositions that may be suitable are disclosed in GB 1817863.2, filed Nov. 1, 2018, titled Aerosolisable Formulation; GB 1817864.0, filed Nov. 1, 2018, titled Aerosolisable Formulation; GB 1817867.3, filed Nov. 1, 2018, titled Aerosolisable Formulation; GB 1817865.7, filed Nov. 1, 2018, titled Aerosolisable Formulation; GB 1817859.0, filed Nov. 1, 2018, titled Aerosolisable Formulation; GB 1817866.5, filed Nov. 1, 2018, titled Aerosolisable Formulation; GB 1817861.6, filed Nov. 1, 2018, titled Gel and Crystalline Powder; GB 1817862.4, filed Nov. 1, 2018, titled Aerosolisable Formulation; GB 1817868.1, filed Nov. 1, 2018, titled Aerosolised Formulation; and GB 1817860.8, filed Nov. 1, 2018, titled Aerosolised Formulation, each of which is incorporated by reference herein in its entirety.

In some embodiments, the aerosol precursor composition may incorporate nicotine, which may be present in various concentrations. The source of nicotine may vary, and the nicotine incorporated in the aerosol precursor composition may derive from a single source or a combination of two or more sources. For example, in some embodiments the aerosol precursor composition may include nicotine derived from tobacco. In other embodiments, the aerosol precursor composition may include nicotine derived from other organic plant sources, such as, for example, non-tobacco plant sources including plants in the Solanaceae family. In other embodiments, the aerosol precursor composition may include synthetic nicotine. In some embodiments, nicotine incorporated in the aerosol precursor composition may be derived from non-tobacco plant sources, such as other members of the Solanaceae family.

In some embodiments, the aerosol precursor composition may additionally or alternatively include other active ingredients including, but not limited to, botanical ingredients (e.g., lavender, peppermint, chamomile, basil, rosemary, thyme, *eucalyptus*, ginger, *cannabis, ginseng*, maca, and tisanes), stimulants (e.g., caffeine and guarana), amino acids (e.g., taurine, theanine, phenylalanine, tyrosine, and tryptophan) and/or pharmaceutical, nutraceutical, and medicinal ingredients (e.g., vitamins, such as B6, B12, and C and cannabinoids, such as tetrahydrocannabinol (THC) and cannabidiol (CBD)). Generally, the amount of active ingredient in the aerosol precursor composition may vary. For example, in some embodiments, the aerosol precursor composition may include at least one active ingredient in an amount of about 0.1% to about 20% by weight, based on the total weight of the aerosol precursor composition. In some embodiments, the aerosol precursor composition may include at least one active ingredient in an amount of at least 1% by weight, at least 2% by weight, at least 3% by weight, at least 4% by weight, at least 5% by weight, at least 6% by weight, at least 7% by weight, at least 8% by weight, at least 9% by weight, at least 10% by weight, or more, based on the total weight of the aerosol precursor composition.

In some embodiments, the aerosol precursor composition may incorporate tobacco or components derived from tobacco. In one regard, the tobacco may be provided as parts or pieces of tobacco, such as finely ground, milled or powdered tobacco lamina. Tobacco beads, pellets, or other solid forms may be included, such as described in U.S. Pat. App. Pub. No. 2015/0335070 to Sears et al., the disclosure of which is incorporated herein by reference in its entirety.

In another regard, the tobacco may be provided in the form of an extract, such as a spray dried extract that incorporates many of the water soluble components of tobacco. Alternatively, tobacco extracts may have the form of relatively high nicotine content extracts, which extracts also incorporate minor amounts of other extracted components derived from tobacco. In another regard, components derived from tobacco may be provided in a relatively pure form, such as certain flavoring agents that are derived from tobacco. In one regard, a component that is derived from tobacco, and that may be employed in a highly purified or essentially pure form, is nicotine (e.g., pharmaceutical grade nicotine, USP/EP nicotine, etc.). In other embodiments, non-tobacco materials alone may form the aerosol precursor composition. In some embodiments, the aerosol precursor composition may include tobacco-extracted nicotine with tobacco or non-tobacco flavors and/or non-tobacco-extracted nicotine with tobacco or non-tobacco flavors.

As noted above, in various embodiments the liquid composition may include a flavorant. In some embodiments, the flavorant may be pre-mixed with the liquid. In other embodiments, the flavorant may be delivered separately downstream from the atomizer as a main or secondary flavor. Still other embodiments may combine a pre-mixed flavorant with a downstream flavorant. As used herein, reference to a "flavorant" refers to compounds or components that can be aerosolized and delivered to a user and which impart a sensory experience in terms of taste and/or aroma. Example flavorants include, but are not limited to, vanillin, ethyl vanillin, cream, tea, coffee, fruit (e.g., apple, cherry, strawberry, peach and citrus flavors, including lime, lemon, mango, and other citrus flavors), maple, menthol, mint, peppermint, spearmint, wintergreen, nutmeg, clove, lavender, cardamom, ginger, honey, anise, sage, rosemary, hibiscus, rose hip, yerba mate, guayusa, honeybush, rooibos, amaretto, mojito, yerba santa, *ginseng*, chamomile, turmeric, bacopa monniera, gingko *biloba*, withania somnifera, cinnamon, sandalwood, jasmine, cascarilla, cocoa, licorice, terpenes, trigeminal sensates, and flavorings and flavor packages of the type and character traditionally used for the flavoring of cigarette, cigar, and pipe tobaccos. Other examples include flavorants derived from, or simulating, burley, oriental tobacco, flue cured tobacco, etc. Syrups, such as high fructose corn syrup, also can be employed. Example plant-derived compositions that may be suitable are disclosed in U.S. Pat. No. 9,107,453 and U.S. Pat. App. Pub. No. 2012/0152265 both to Dube et al., the disclosures of which are incorporated herein by reference in their entireties. The selection of such further components are variable based upon factors such as the sensory characteristics that are desired for the smoking article, and the present disclosure is intended to encompass any such further components that are readily apparent to those skilled in the art of tobacco and tobacco-related or tobacco-derived products. See, e.g., Gutcho, Tobacco Flavoring Substances and Methods, Noyes Data Corp. (1972) and Leffingwell et al., Tobacco Flavoring for Smoking Products (1972), the disclosures of which are incorporated herein by reference in their entireties. It should be noted that reference to a flavorant should not be limited to any single flavorant as described above, and may, in fact, represent a combination of one or more flavorants.

In some embodiments, cartridge portions 104 of the present invention may be provided in a variety of different configurations and with a variety of different components. For example, the depicted embodiment in FIG. 5 illustrates a cartridge portion 104 including a housing 301 with an air pathway 300 extending at least partially therethrough; a reservoir 302 configured to contain a content of a liquid composition; an intermediate chamber 304 configured to temporarily store a fractional content of the liquid composition; a micropump 306 interconnecting the reservoir and the intermediate chamber and configured to deliver the fractional content of the liquid composition from the reservoir to the intermediate chamber under pressure; and a mesh layer 308 positioned at least partially between the intermediate chamber and the air pathway, the mesh layer being adapted to transfer the liquid composition received from the intermediate chamber into the air pathway while converting the liquid composition into an aerosol.

In the depicted embodiment, the cartridge 104 may further comprise one or more components in addition to the air pathway 300, housing 301, reservoir 302, intermediate chamber 304, micropump 306, and the mesh layer 308 as described herein above. Any of these additional components can be provided in a variety of different configurations and can be positioned at varying locations throughout the cartridge portion 104 of the aerosol delivery device according to the present disclosure. Further, the cartridge portions 104 as described in the depicted embodiment (FIG. 5) may additionally be coupleable to a control unit 102 as described herein above and depicted in the embodiments of FIGS. 1-3. It should be noted, that aerosol delivery devices as described herein may incorporate any or all of these additional components within a single cartridge portion, such cartridge portion 104 being coupleable to a control unit 102 as described herein above, to form an aerosol delivery device 100. In addition, the dashed lines in FIG. 5 represent inter-connection of components within the cartridge portion. As noted above with respect to FIG. 2 and FIG. 3, these dashed lines may represent direct connection between all components within the cartridge, indirect connection between all components within the cartridge (e.g., such as by way of one or more conduits suitable for transporting a liquid composition), or any combination of direct and indirect connection of components. The types of conduits or liquid transport elements used may vary and any suitable conduit or tubing may be used, such as those described herein above. Further, this direct and/or indirect connection of various components within the cartridge may provide fluid communication between one or more of the reservoir, the micropump, the one or more chambers, and the mesh later.

In the depicted embodiment, the air pathway 300 may be in the form of a tube that extends partially through the housing 301 and abutting the mesh layer 308, rather than in the form of an open void in the housing extending partially therethrough as depicted in FIGS. 2 and 3 and as described herein above. The air pathway 300 according to this embodiment may extend the entire length of the cartridge or along just a portion of the length of the cartridge. In addition, the air pathway may be substantially cylindrical in shape or in various other shapes. Preferably, in embodiments wherein the air pathway 300 is substantially cylindrical in shape, the intermediate chamber 304 and optionally the reservoir 302 may be substantially disk-like in shape such that the intermediate chamber 304 and optionally the reservoir 302 are both configured to circumscribe the air pathway 300. In such an embodiment, the mesh layer 308 may be positioned at least partially between the intermediate chamber 304 and the air pathway 300, the mesh layer 308 being adapted to transfer the liquid composition received from the intermediate chamber into the air pathway while converting the liquid composition into an aerosol.

In the depicted embodiment, the cartridge portion 104 of the aerosol delivery device may further comprise a forced-air component 310 (e.g., such as the forced air components described herein above with respect to FIG. 3) configured to direct air through the air pathway 300 and out of the opening in the mouthend of the cartridge 104. In some embodiments the forced-air component 310 may be provided in variety of forms, for example, micropumps, microblowers, and/or air compressors. Suitable forced-air components may include, but are not limited to, a micro-compressor pump, a micro-blower, a rotary micropump, a diaphragm micropump, an air compressor, and a piezoceramic micropump. In some embodiments, a micro blower assembly may be used which comprises a micro compressor. In some embodiments, the micro blower assembly may utilize a pressurized gas (e.g., air, carbon dioxide (CO2), nitrogen (N2), etc.) to aid in propelling the liquid composition to the surface of the mesh layer 308. In some embodiments, the micro blower assembly may include one or more nozzles designed to increase the flow rate of the air exiting the micro blower.

As noted above, it is possible to provide an air intake in the cartridge portion of the aerosol delivery device instead of in the control unit as depicted in FIG. 2 and FIG. 3. For example, in the embodiment depicted in FIG. 5, the cartridge 104 may further comprise an air intake 312 in the cartridge housing 301 that is configured to receive ambient air within the cartridge 104. In the depicted embodiment in FIG. 5, the forced-air component 310 may be in fluid communication with the air intake 312 such that air is drawn into the forced-air component 310 from outside of the aerosol delivery device when the forced-air component 310 is activated. Optionally, in some embodiments such fluid communication between components may be achieved by connecting the forced-air component 310 with the air intake 312 via a conduit (e.g., represented by a transport element 314 as illustrated in FIG. 5) configured to transfer air received by the air intake to the forced-air component. The transport element 314 may be in the form of a conduit or any tubular casing capable of transporting a flow of air from the air intake 312 to the forced-air component 310. Alternatively, in some embodiments the forced-air component can be configured to draw air directly into the forced-air component, such that use of a transport element is not necessary. In some embodiments, the forced-air component may further comprise a filter component configured to reduce the amount of particulates that accumulate inside the forced-air component. Further, the incorporation of a forced air component in some embodiments may reduce the amount of suction that a user has to apply to the mouthend of the aerosol delivery device in order to convert the liquid composition present on the surface of the mesh layer 308 into a vapor or an aerosol.

In the depicted embodiment, the cartridge portion 104 of the aerosol delivery device may further comprise a heater 316 in direct connection with the mesh layer 308. As described hereinafter, the heater may be referred to as a "heating component", a "heating apparatus", and/or a "heating element" and may be positioned in various locations within the cartridge portion 104 of the aerosol delivery device. The heater 316 may be in the form of a coil heating component, a ceramic heating component, an electrical heating component, a heating wire, and/or any heating element generally known in the art that would be suitable for transferring heat to the mesh layer. In some embodiments, a heater 316 may be positioned in the cartridge portion 104 of the aerosol delivery device and configured to heat the mesh layer 308 directly. In some embodiments, for example, the heater may be directly connected to the mesh layer or indirectly connected to the mesh layer (e.g., such as through a heat transfer element or a heating wire interconnecting the heater and the mesh layer) as depicted by line 318 connecting the heater 316 and the mesh layer 308 in FIG. 5. Such embodiments may advantageously provide a heated mesh layer exhibiting an increased surface energy as compared to a non-heated mesh layer. Further, such embodiments may make it easier to generate an aerosol when a user draws on the device as compared to aerosol delivery devices not including a heated mesh layer. Suitable heaters and heater components may include, but are not limited to, coil heating components, ceramic heating components, electrical heating components, heating wires within the mesh layer, and/or any other heating apparatus suitable for transferring heat directly to the mesh component.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. An aerosol delivery device comprising:

a housing with an air pathway extending at least partially therethrough;

a reservoir configured to contain a content of a liquid composition;

an intermediate chamber configured to temporarily store a fractional content of the liquid composition;

a micropump interconnecting the reservoir and the intermediate chamber and configured to deliver the fractional content of the liquid composition from the reservoir to the intermediate chamber under pressure; and a mesh layer positioned at least partially between the intermediate chamber and the air pathway, the mesh layer being adapted to transfer the liquid composition received from the intermediate chamber into the air pathway forming an aerosol.

2. The aerosol delivery device of claim 1, wherein the micropump is selected from the group consisting of a centrifugal micropump, a ring micropump, a rotary micropump, a diaphragm micropump, a peristaltic micropump, a step micropump, and combinations thereof.

3. The aerosol delivery device of claim 1, wherein the housing comprises at least one opening for receiving air, and wherein the air pathway is in fluid communication with the at least one opening such that air is drawn into the air pathway from outside of the aerosol delivery device when a drawing force is applied to the aerosol delivery device by a user.

4. The aerosol delivery device of claim 1, wherein the aerosol delivery device further comprises a forced air component configured to draw air from outside of the housing through the air pathway.

5. The aerosol delivery device of claim 4, wherein the forced air component is selected from the group consisting of a micro-compressor pump, a micro-blower, a rotary micropump, a diaphragm micropump, a piezoceramic micropump, and combinations thereof.

6. The aerosol delivery device of claim 1, wherein the intermediate chamber is substantially disk-shaped and is in connection with the mesh layer.

7. The aerosol delivery device of claim 1, wherein the aerosol delivery device further comprises a second chamber that is in connection with the intermediate chamber and thus is fluidly connected with the reservoir.

8. The aerosol delivery device of claim 1, wherein the liquid composition is a water-based aerosol precursor composition.

9. The aerosol delivery device of claim 8, wherein the water-based aerosol precursor composition comprises about 60% or greater water by weight, based on the total weight of the water-based aerosol precursor composition.

10. The aerosol delivery device of claim 8, wherein the water-based aerosol precursor composition comprises one or more of a polyhydric alcohol, tobacco, a tobacco extract, a flavorant, an acid, a nicotine component, botanicals, nutraceuticals, stimulants, amino acids, vitamins, cannabinoids, and combinations thereof.

11. The aerosol delivery device of claim 1, further comprising an input element configured to be operated by a user of the aerosol delivery device and in communication with a control component.

12. The aerosol delivery device of claim 11, wherein the control component is in communication with the micropump and configured to control the amount of the liquid composition transferred from the reservoir to the intermediate chamber via the micropump.

13. The aerosol delivery device of claim 12, wherein the input element is configured to allow a user to adjust the amount of nicotine delivered per puff.

14. The aerosol delivery device of claim 12, wherein the input element is configured to adjust the amount of total particulate matter (TPM) released per puff.

15. The aerosol delivery device of claim 1, wherein the mesh layer is a porous mesh or porous ceramic material.

16. The aerosol delivery device of claim 1, wherein the mesh layer is substantially linear or is substantially curved.

17. The aerosol delivery device of claim 1, wherein the mesh layer comprises a plurality of openings extending therethrough.

18. The aerosol delivery device of claim 17, wherein the plurality of openings comprises from about 400 openings to about 4000 openings.

19. The aerosol delivery device of claim 17, wherein the plurality of openings each extend from an inner surface of the mesh layer to an outer surface of the mesh layer, and wherein a diameter of the plurality of openings changes from the inner surface to the outer surface.

20. The aerosol delivery device of claim 19, wherein the diameter of the plurality of openings is relatively smaller at the inner surface of the mesh layer and is relatively larger at the outer surface of the mesh layer.

21. The aerosol delivery device of claim 20, wherein the smaller side is about 0.5 microns to about 5 microns in diameter and the larger side is about 2 microns to about 100 microns in diameter.

22. The aerosol delivery device of claim 1, wherein the reservoir is replaceable or refillable by a user of the aerosol delivery device.

23. The aerosol delivery device of claim 1, wherein the content of the liquid composition in the reservoir is sufficient to equate to substantially 50 puffs to a user of the aerosol delivery device prior to depletion of the liquid composition.

24. The aerosol delivery device of claim 1, further comprising a power source and a second control component, wherein the second control component is configured to control the power output from the power source.

25. The aerosol delivery device of claim 1, further comprising a mouthpiece portion configured to receive the aerosol from the air pathway and having an opening for egress of the aerosol therefrom.

26. The aerosol delivery device of claim 1, wherein the mesh layer is heated.

27. The aerosol delivery device of claim 26, wherein the heated mesh layer has an increased surface energy as compared to a non-heated mesh layer.

* * * * *